US009359156B2

(12) United States Patent
Shimazu

(10) Patent No.: US 9,359,156 B2
(45) Date of Patent: Jun. 7, 2016

(54) PAPER FEEDING APPARATUS DETECTING RECORDING PAPER PRESENCE/ABSENCE, PAPER FEED CASSETTE ATTACHING/DETACHING, AND LIFT PLATE REACHING RISING STOP POSITION, AND IMAGE FORMING APPARATUS EQUIPPED WITH THE SAME

(71) Applicant: KYOCERA Document Solutions Inc., Osaka (JP)

(72) Inventor: Kozo Shimazu, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/583,602

(22) Filed: Dec. 27, 2014

(65) Prior Publication Data

US 2015/0183596 A1 Jul. 2, 2015

(30) Foreign Application Priority Data

Dec. 27, 2013 (JP) ..... 2013-271929

(51) Int. Cl.
*B65H 1/18* (2006.01)
*B65H 1/04* (2006.01)
(Continued)

(52) U.S. Cl.
CPC .. *B65H 1/14* (2013.01); *B65H 1/04* (2013.01); *B65H 1/18* (2013.01); *B65H 1/266* (2013.01); *B65H 7/02* (2013.01); *B65H 7/14* (2013.01); *B65H 7/20* (2013.01); *B65H 2511/212* (2013.01); *B65H 2511/414* (2013.01); *B65H 2511/51* (2013.01); *B65H 2551/27* (2013.01);
(Continued)

(58) Field of Classification Search
CPC ..... B65H 7/04; B65H 7/02; B65H 7/18; B65H 1/04; B65H 1/08; B65H 1/12; B65H 1/14; B65H 1/18; B65H 1/266
See application file for complete search history.

(56) References Cited

U.S. PATENT DOCUMENTS 8,042,801 B2 * 10/2011 You ..... 271/157
8,070,153 B2 * 12/2011 Kang ..... 271/164
(Continued)

FOREIGN PATENT DOCUMENTS

JP H08-026527 1/1996
JP 2000038240 A * 2/2000
JP 2000118792 A * 4/2000
JP 2002-172832 A 6/2002

*Primary Examiner* — Luis A Gonzalez
(74) *Attorney, Agent, or Firm* — Hawaii Patent Services; Nathaniel K. Fedde; Kenton N. Fedde

(57) ABSTRACT

Provided is a paper feeding apparatus that commonalizes mechanisms for detecting paper feed cassette attaching/detaching, recording paper presence/absence, and lift plate reaching rising stop position. When paper feed cassette is removed, a contact piece has first inclination, a light shielding piece has first position, and a first sensor and a second sensor are OFF. When paper feed cassette having no recording paper is inserted, contact piece has second inclination by an opening edge part; light shielding piece has second position; and a first sensor is OFF, a second sensor being ON. When recording paper is on lift plate, contact piece has third inclination by recording paper, light shielding piece having third position, and first sensor and second sensor being ON. When lift plate is raised to rising stop position, contact piece has fourth inclination, light shielding piece having fourth position, first sensor being ON and second sensor being OFF.

4 Claims, 9 Drawing Sheets

(51) Int. Cl.

| | |
|---|---|
| ***B65H 7/04*** | (2006.01) |
| ***B65H 1/14*** | (2006.01) |
| ***B65H 7/14*** | (2006.01) |
| ***B65H 7/20*** | (2006.01) |
| ***B65H 1/26*** | (2006.01) |
| ***B65H 7/02*** | (2006.01) |

(52) U.S. Cl.
CPC ..... *B65H 2553/412* (2013.01); *B65H 2553/612* (2013.01); *B65H 2553/80* (2013.01)

(56) References Cited

U.S. PATENT DOCUMENTS

| | | | | |
|---|---|---|---|---|
| 8,282,093 | B2 * | 10/2012 | Sugishima | 271/152 |
| 8,403,318 | B2 * | 3/2013 | Shiraishi | 271/31 |
| 2004/0041329 | A1 * | 3/2004 | Hiraoka | 271/110 |
| 2005/0236760 | A1 * | 10/2005 | Kang | 271/152 |
| 2006/0087070 | A1 * | 4/2006 | Cook et al. | 271/145 |

* cited by examiner

| | State | Position of light shielding piece | First sensor output value | Second sensor output value |
|---|---|---|---|---|
| (1) | Paper feed cassette is not yet loaded | 1st position | OFF | OFF |
| (2) | Paper feed cassette is loaded with no paper | 2nd position | OFF | ON |
| (3) | Paper feed cassette is loaded with paper | 3rd position | ON | ON |
| (4) | Paper feed cassette has reached rising stop position | 4th position | ON | OFF |

FIG.5

PAPER FEEDING APPARATUS DETECTING RECORDING PAPER PRESENCE/ABSENCE, PAPER FEED CASSETTE ATTACHING/DETACHING, AND LIFT PLATE REACHING RISING STOP POSITION, AND IMAGE FORMING APPARATUS EQUIPPED WITH THE SAME

INCORPORATION BY REFERENCE

This application is based on and claims the benefit of priority from Japanese Patent Application No. 2013-271929 filed on Dec. 27, 2013, the contents of which are hereby incorporated by reference.

BACKGROUND

The present disclosure relates to a paper feeding apparatus that detects recording paper presence/absence, paper feed cassette attaching/detaching, and lift plate reaching rising stop position, and an image forming apparatus equipped with the same.

With a typical image forming apparatus, recording papers are placed on a paper feed cassette as a laminate, and a lift plate in the paper feed cassette is raised with a lift motor to separate and supply sheet by sheet a recording paper from the uppermost layer of the recording papers loaded on the lift plate for performing image formation on the recording paper that has been supplied.

In one example of typical image forming apparatus that is capable of supplying a paper from the paper feed cassette, detection of whether or not recording papers are placed on the paper feed cassette as a laminate, whether the paper feed cassette is attached or detached, and whether or not the lift plate has reached the rising stop position is performed. A plurality of detection parts are sometimes provided in one image forming apparatus; for example, there are provided both a recording paper remaining quantity detection part and a paper feed cassette attaching/detaching detecting means part in one image forming apparatus.

SUMMARY

The paper feeding apparatus of the present disclosure is a paper feeding apparatus, including an attachable and detachable cassette having a lift plate, a paper being placed thereon, and a raising part to raise the lift plate. The paper feeding apparatus includes a contact piece, being inclined by the lift plate; a light shielding member, being turned in accordance with the inclination of the contact piece; and an optical sensor part, detecting a position of the light shielding member. Further, an opening is formed in the lift plate. The optical sensor part features that it distinguishably detects the light shielding member having reached a first position, upon the cassette having been removed, thereby the contact piece having had a first inclination; the light shielding member having reached a second position, upon the contact piece having been contacted with an opening edge part formed in the lift plate, thereby having had a second inclination; the light shielding member having reached a third position, upon the contact piece having been contacted with the uppermost layer of the paper placed on the lift plate positioned in the lowest position, thereby having had a third inclination; and the light shielding member having reached a fourth position, upon the raising part having been driven to raise the lift plate to a rising stop position to feed the paper, thereby the contact piece having had a fourth inclination.

The image forming apparatus of the present disclosure features that it includes the above-described paper feeding apparatus.

The paper feeding method of the present disclosure is a paper feeding method, being implemented by a paper feeding apparatus including an attachable and detachable cassette having a lift plate, a paper being placed thereon, and a raising part to raise the lift plate.

The paper feeding apparatus includes a contact piece, being inclined by the lift plate; and a light shielding member, being turned in accordance with the inclination of the contact piece. Further, in the lift plate, an opening is formed. The paper feeding method of the present disclosure features that it distinguishably detects the light shielding member having reached a first position, upon the cassette having been removed, thereby the contact piece having had a first inclination; the light shielding member having reached a second position, upon the contact piece having been contacted with an opening edge part formed in the lift plate, thereby having had a second inclination; the light shielding member having reached a third position, upon the contact piece having been contacted with the uppermost layer of the paper placed on the lift plate positioned in the lowest position, thereby having had a third inclination; and the light shielding member having reached a fourth position, upon the raising part having been driven to raise the lift plate to a rising stop position to feed the paper, thereby the contact piece having had a fourth inclination.

BRIEF DESCRIPTION OF THE DRAWINGS

FIG. 5 is a table giving output values of a first sensor and a second sensor for positions of a light shielding piece shown in FIG. 4.

DETAILED DESCRIPTION

Figure 1:
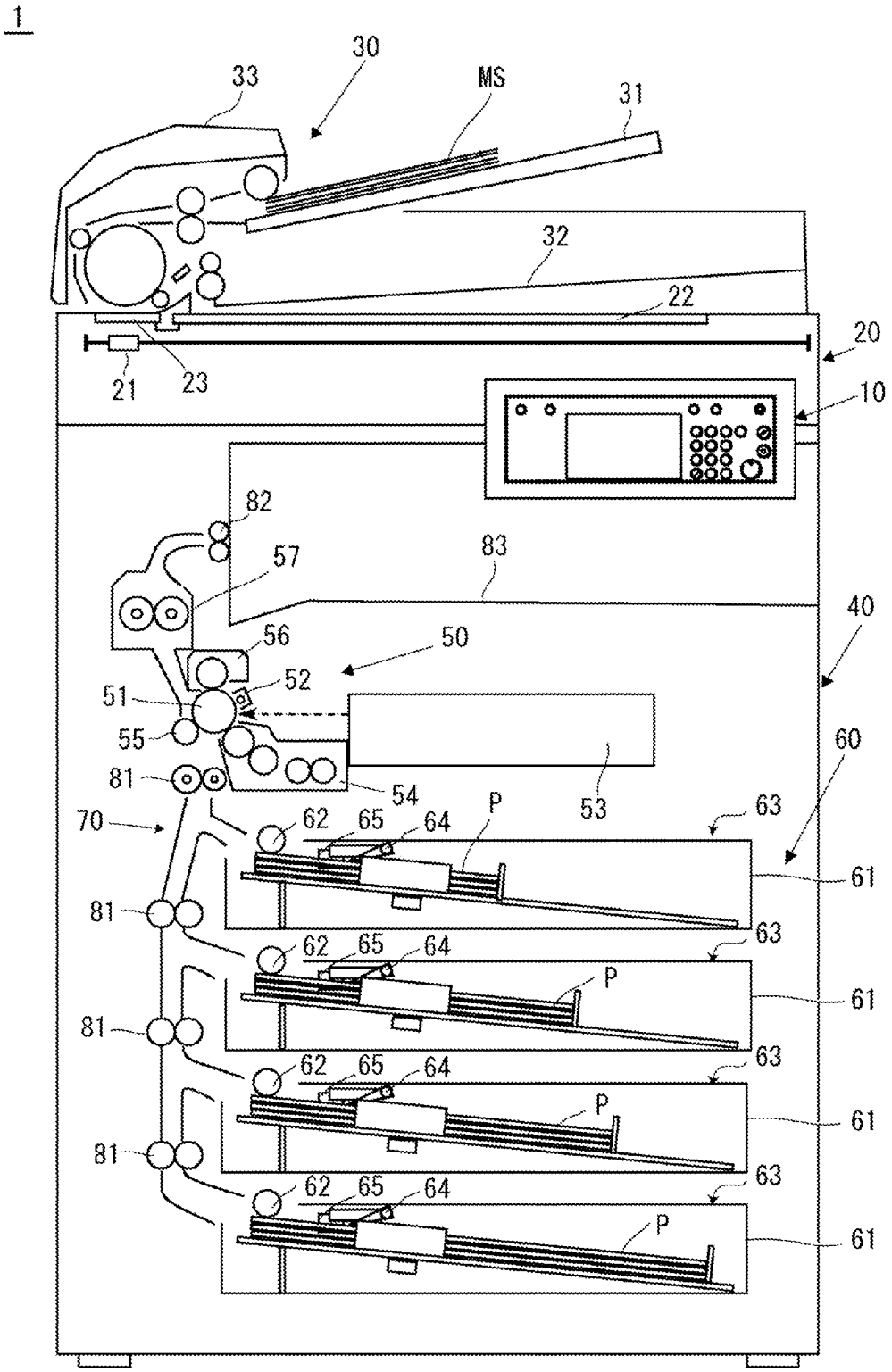
FIG. 1 is a schematic sectional view of an image forming apparatus of an embodiment of the present disclosure.

An embodiment of the present disclosure will be specifically explained with reference to the drawings.

An image forming apparatus 1 having a paper feeding part 60 of the present embodiment is a copying machine. By referring to FIG. 1, the image forming apparatus 1 includes a document reading part 20, a document feeding part 30, and a recording part 40. The document reading part 20 is disposed on top of the recording part 40. The document feeding part 30 is disposed on top of the document reading part 20. The image forming apparatus 1 of the present disclosure is explained using a copying machine, however, needless to say, the image forming apparatus 1 of the present disclosure also refers to a scanner, a Multifunctional Peripheral (MFP), and the like.

On the front side of the image forming apparatus 1, there is disposed a touch panel device 10 for performing setting or an operation instruction for the image forming apparatus 1. On the touch panel device 10, various operation keys are provided. The various operation keys include ten keys, a reset key, a stop key, a start key, and the like. The ten keys are keys for inputting a numerical value, such as the number of printing sheets. The reset key is a key to input an instruction for initializing the set information. The stop key is a key to stop copying operation, or to delete a numerical value that has been inputted. The start key is a key to input an output instruction for starting a printing operation. Further, the touch panel device 10 is provided with a display area for reporting the state of the image forming apparatus 1.

Referring to FIG. 1, the document reading part 20 includes a scanner 21, a platen glass 22, and a document reading slit 23. The scanner 21 is comprised of an exposure lamp, an optical sensor, and the like. The scanner 21 is configured to be movable in a direction of conveyance of a document MS by the document feeding part 30. The platen glass 22 is a document table formed of a transparent material, such as a glass. The document reading slit 23 has a slit that is formed in a direction orthogonal to the direction of conveyance of a document MS by the document feeding part 30.

When reading a document MS placed on the platen glass 22, the scanner 21 is moved to a position opposed to the platen glass 22. The scanner 21 reads the document MS placed on the platen glass 22 for acquiring image data while scanning the document MS. The scanner 21 outputs the acquired image data to the recording part 40. Further, when reading a document MS carried by the document feeding part 30, the scanner 21 is moved to a position opposed to the document reading slit 23. In this case, the scanner 21 reads the document MS through the document reading slit 23 in synchronization with the document carrying operation of the document feeding part 30. At this time, the scanner 21 acquires image data, and outputs the acquired image data to the recording part 40.

The document feeding part 30 includes a document mounting part 31, a document discharge part 32, and a document carrying mechanism 33. The documents MS placed on the document mounting part 31 are fed in turn sheet by sheet by the document carrying mechanism 33. The document MS is carried to a position opposed to the document reading slit 23, and thereafter discharged into the document discharge part 32. The document feeding part 30 is configured to be tiltable. Therefore, by bringing the document feeding part 30 upward, the top face of the platen glass 22 can be opened.

The recording part 40 includes an image forming part 50, and also includes a paper feeding part 60, a carrying passage 70, conveyance rollers 81, discharge rollers 82, and a delivery tray 83.

The paper feeding part 60 includes a paper feed cassette 61, a feed roller 62, and a cassette accommodating space 63. The paper feed cassette 61 accommodates recording papers P which are laminated. The feed roller 62 feeds the recording papers P sheet by sheet from the paper feed cassette 61 to the carrying passage 70. The cassette accommodating space 63 accommodates the paper feed cassette 61. Further, the paper feeding part 60 includes an actuator 64 that is turnable, and an optical sensor part 65. The optical sensor part 65 detects a turned position of the actuator 64. The actuator 64 and the optical sensor part 65 will be described later. The feed roller 62, the conveyance rollers 81, and the discharge rollers 82 function as a conveyance part. The recording paper P is conveyed by this conveyance part. The recording paper P is fed by the feed roller 62 into the carrying passage 70. Thereafter, the recording paper P is conveyed by the conveyance rollers 81 into the image forming part 50. Then, the recording paper P is provided with a record by the image forming part 50. Thereafter, the recording paper P is guided by the discharge rollers 82 to be delivered to the delivery tray 83.

The image forming part 50 includes a photosensitive drum 51, an electrifying part 52, an exposure part 53, a developing part 54, a transfer part 55, a cleaning part 56, and a fixing part 57. The exposure part 53 is an optical unit including a laser apparatus, a mirror, and the like. The exposure part 53 outputs a laser beam on the basis of the image data to expose the photosensitive drum 51 that has been electrified by the electrifying part 52. Thereby, an electrostatic latent image is formed on the surface of the photosensitive drum 51. The developing part 54 is a developing unit that uses toner for developing the electrostatic latent image formed on the photosensitive drum 51. The developing part 54 causes a toner image based on the electrostatic latent image to be formed on the photosensitive drum 51. The transfer part 55 causes the toner image formed on the photosensitive drum 51 by the developing part 54 to be transferred onto the recording paper P. The fixing part 57 causes the toner image to be fixed on the recording paper P by heating the recording paper P onto which the toner image has been transferred by the transfer part 55.

Next, the configuration of the paper feed cassette 61 will be explained in detail with reference to FIG. 2.

The main body part of the paper feed cassette 61 is constituted by a cassette frame 610. The main body part of the paper feed cassette 61 is horizontally slid in the direction of arrow A shown in FIG. 2 to be inserted into the cassette accommodating space 63 of the image forming apparatus 1. The cassette frame 610 is configured in the shape of a flat box the top of which is opened. On the bottom face of the cassette frame 610, there is provided a lift plate 611 in which an opening 611*a* is formed. The recording papers P are loaded on the lift plate 611, and are fed in the direction of arrow B shown in FIG. 2. The end of the lift plate 611 that is located on the upstream side in the direction along which the recording paper P is fed is supported by the bottom face of the cassette frame 610. The lift plate 611 is configured so as to be swung around that upstream side end, thereby the downstream side end being provided as a free end. When the paper feed cassette 61 is inserted into the image forming apparatus 1, the motor joint part 612 is connected to a lift motor (not shown). With the lift motor being rotation-driven, the downstream side end of the lift plate 611 is raised, the recording paper P on the lift plate 611 being abutted against the feed roller 62. Thereby, the preparation for paper feeding is completed.

Figure 3:
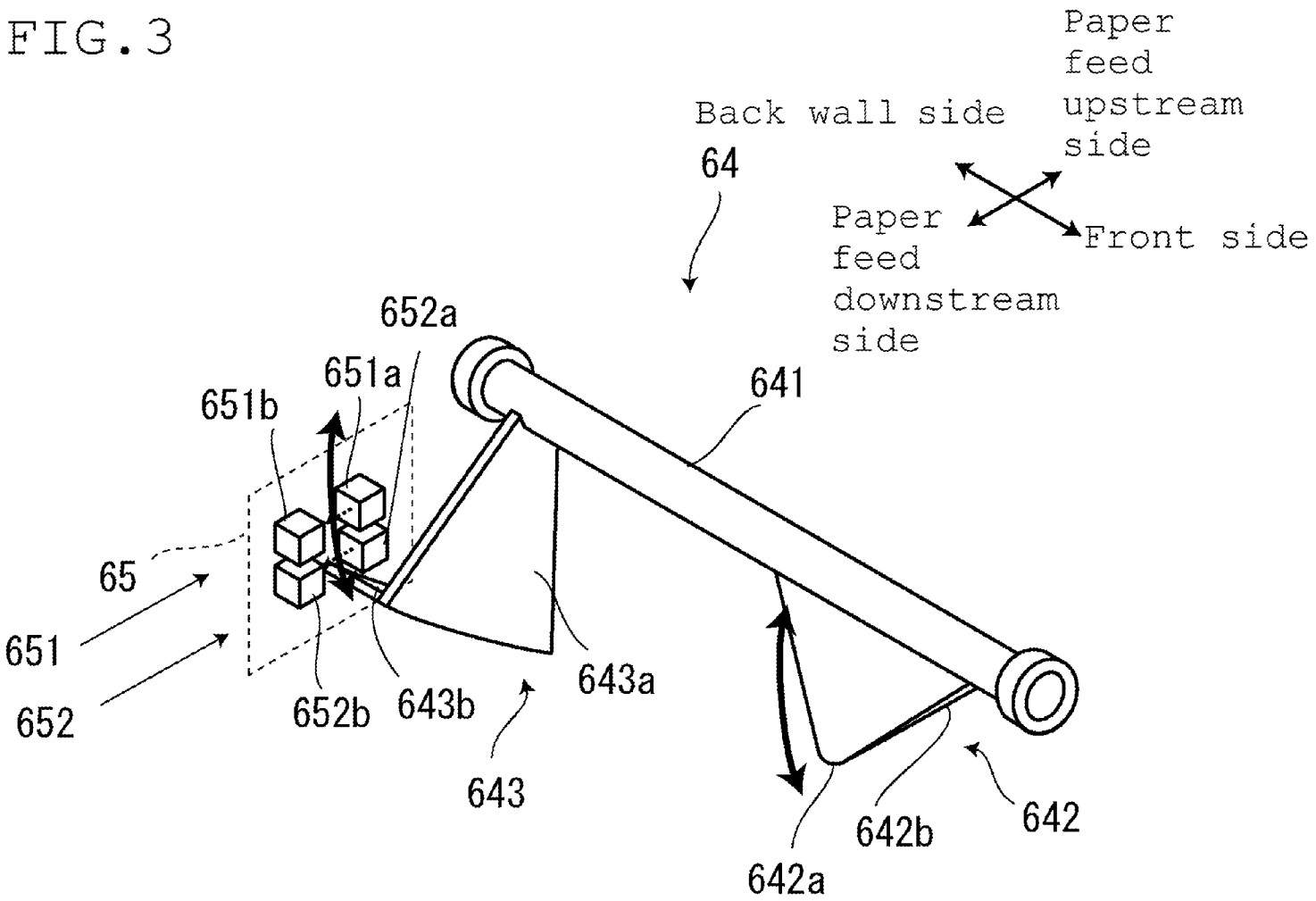
FIG. 3 is a perspective view of an actuator and an optical sensor part shown in FIG. 1.

FIG. 3 is a perspective view showing the actuator 64 and the optical sensor part 65 that are mounted in the cassette accommodating space 63. The actuator 64 has a shaft part 641, a contact piece 642, and a light shielding member 643. The shaft part 641 is pivotally supported by the image forming apparatus 1 such that the paper feeding direction of the paper feed cassette 61 is orthogonal to the axial direction thereof. The contact piece 642 and the light shielding member 643 are mounted to the shaft part 641, respectively.

The contact piece 642 extends from the shaft part 641 toward the bottom face of the cassette accommodating space 63. When the paper feed cassette 61 is inserted into the cassette accommodating space 63, the contact piece 642 is brought into contact with the opening edge part 611*b* of the lift plate 611 or the recording paper P placed on the lift plate 611 from the top face side of the cassette frame 610 that is opened. The contact piece 642 is configured so as to be inclined above the lift plate 611 in the direction of rotation of the shaft part 641. Further, the contact piece 642 is provided with a taper such that, at the time of the paper feed cassette 61 being inserted, or the like, the contact piece 642 easily rides on the lift plate 611 or the recording paper P loaded on the lift plate 611.

The light shielding member 643 is in the shape of the letter Δ when viewed from a direction facing the axis of the shaft part 641. The light shielding member 643 is constituted by a flat plate member 643*a*, which extends from the shaft part 641 in a plane orthogonal to the axis thereof, and a light shielding piece 643*b*, which extends from the distal end part of the flat plate member 643*a* toward the back wall. When the paper feed cassette 61 is inserted into the cassette accommodating space 63, between the back wall of the paper feed cassette 61 and the back wall of the image forming apparatus 1, there is formed a space that allows the light shielding member 643 to be turned in the direction of rotation of the shaft part 641. The light shielding member 643 is provided so as to be positioned in this space. When the contact piece 642 is inclined, the shaft part 641 is rotated, thereby the light shielding member 643 being turned.

On the back wall of the cassette accommodating space 63 in the image forming apparatus 1, there is provided an optical sensor part 65 for detecting a position of the light shielding piece 643*b*. The optical sensor part 65 has a first sensor 651 and a second sensor 652. The first sensor 651 includes a light emitting part 651*a* for emitting light and a light receiving part 651*b* for receiving light from the light emitting part 651*a*. The second sensor 652 includes a light emitting part 652*a* for emitting light, and a light receiving part 652*b* for receiving light from the light emitting part 652*a*. The first sensor 651 is provided at a location closer to the top of the cassette accommodating space 63 than the location of the second sensor 652. The light shielding piece 643*b* is turned between the light emitting part 651*a* and the light receiving part 651*b* of the first sensor 651, and between the light emitting part 652*a* and the light receiving part 652*b* of the second sensor 652 in accordance with the inclination of the contact piece 642. When the light shielding piece 643*b* is positioned between the light emitting part 651*a* and the light receiving part 651*b* of the first sensor 651, thereby the light from the light emitting part 651*a* being shielded by the light shielding piece 643*b*, the first sensor 651 is turned ON. When the light shielding piece 643*b* is not positioned between the light emitting part 651*a* and the light receiving part 651*b* of the first sensor 651, thereby the light from the light emitting part 651*a* being received by the light receiving part 651*b*, the first sensor 651 is turned OFF. Likewise, when the light shielding piece 643*b* is positioned between the light emitting part 652*a* and the light receiving part 652*b* of the second sensor 652, thereby the light from the light emitting part 652*a* being shielded by the light shielding piece 643*b*, the second sensor 652 is turned ON. When the light shielding piece 643*b* is not positioned between the light emitting part 652*a* and the light receiving part 652*b* of the second sensor 652, thereby the light from the light emitting part 652*a* being received by the light receiving part 652*b*, the second sensor 652 is turned OFF.

Referring to FIG. 4A, FIG. 4B, FIG. 4C, FIG. 4D, and FIG. 5, the relationship among the state of the paper feeding part 60, the position of the light shielding piece 643*b*, the output value of the first sensor 651, and the output value of the second sensor 652 will be explained.

Figure 4A:
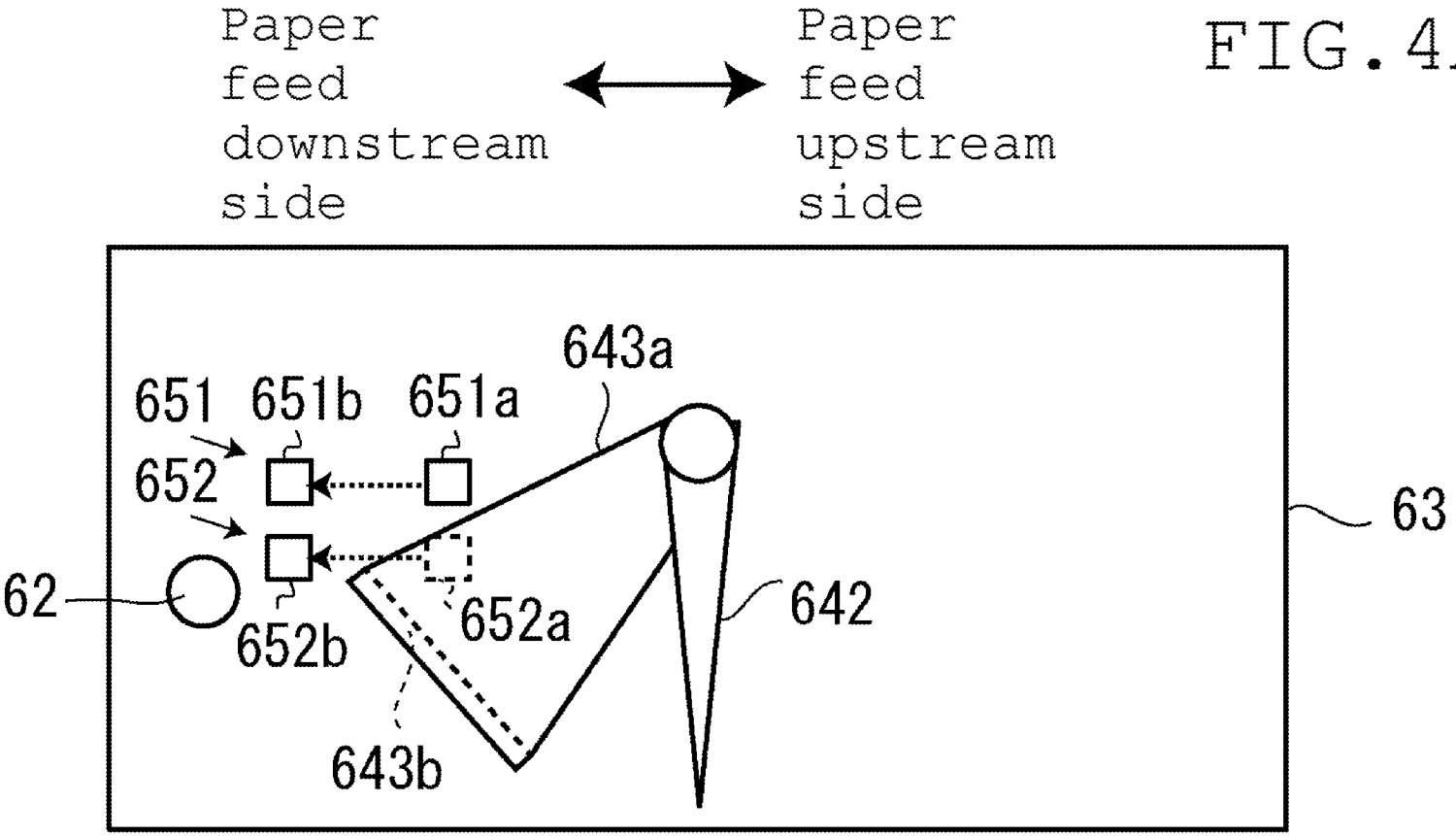
FIG. 4A is an image figure showing the motion of the actuator shown in FIG. 1.
Figure 4B:
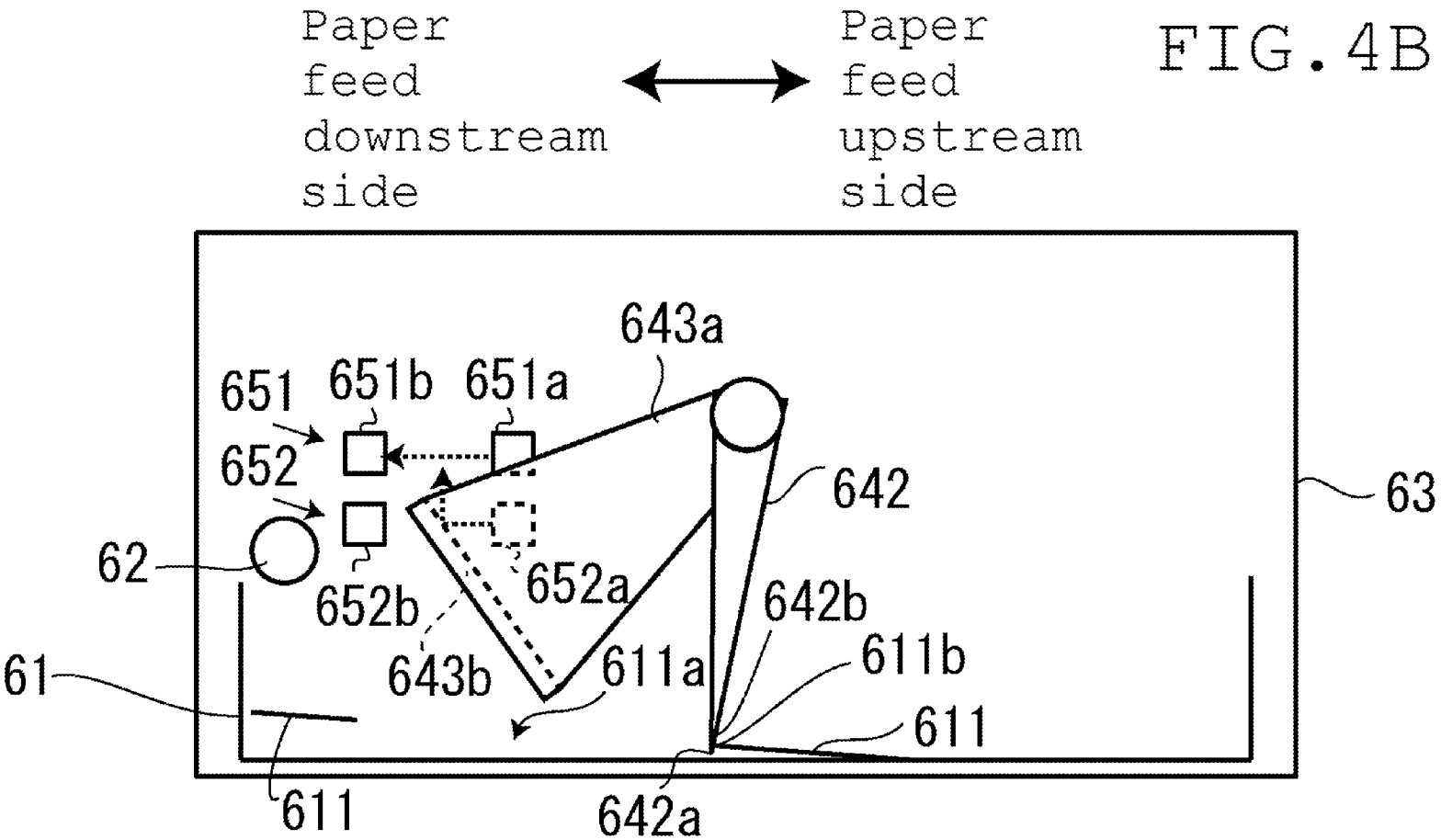
FIG. 4B is an image figure showing the motion of the actuator shown in FIG. 1.

As shown in FIG. 4A, when the paper feed cassette 61 is removed from the cassette accommodating space 63, the contact piece 642 is provided with a first inclination by its own weight. When the contact piece 642 has the first inclination, the light shielding piece 643*b* is turned to a first position where the first sensor 651 and the second sensor 652 are turned OFF. As shown in FIG. 4B, when the paper feed cassette 61 is inserted into the cassette accommodating space 63 with no recording paper P being loaded on the lift plate 611, the side part 642*b* of the contact piece 642 is contacted with the opening edge part 611*b* of the opening 611*a* formed in the lift plate 611, thereby the contact piece 642 being provided with a second inclination. When the contact piece 642 has the second inclination, the light shielding piece 643*b* is turned to a second position where the first sensor 651 is turned OFF, and the second sensor 652 is turned ON.

Figure 2:
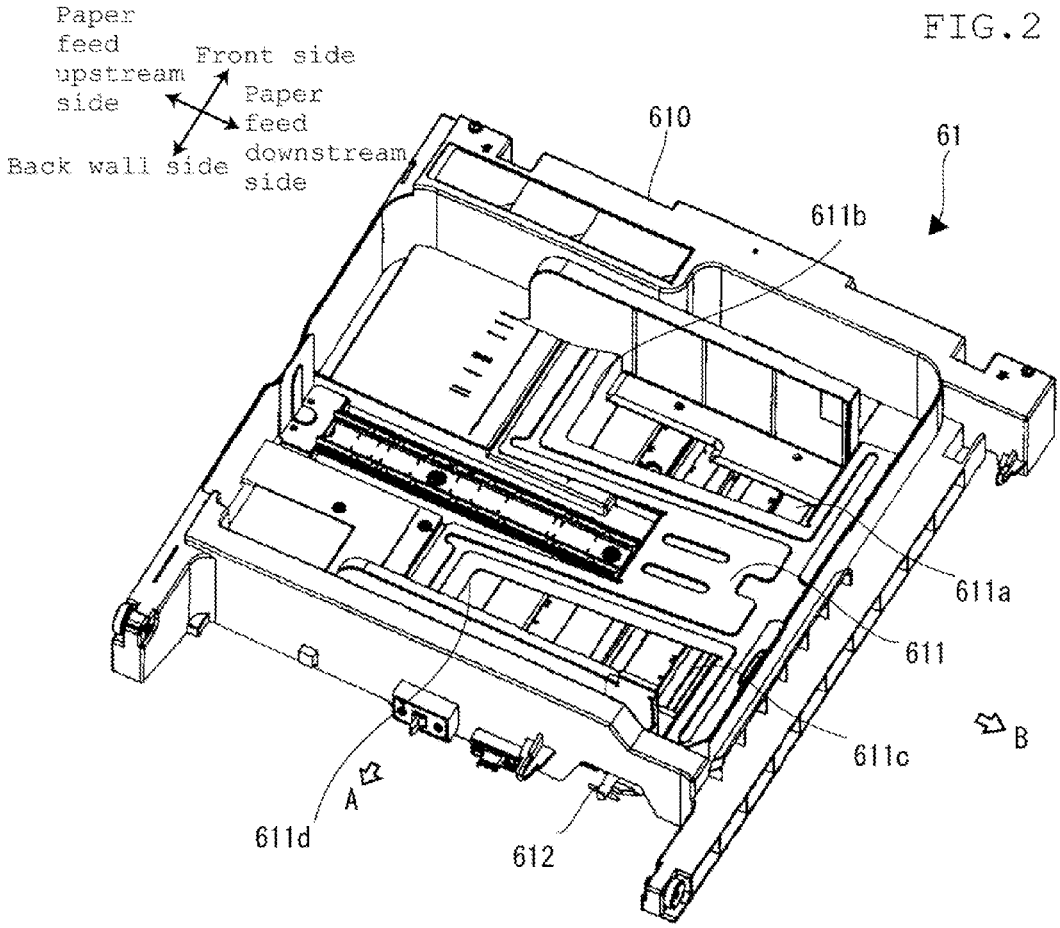
FIG. 2 is a perspective view of a paper feed cassette shown in FIG. 1.
Figure 6:
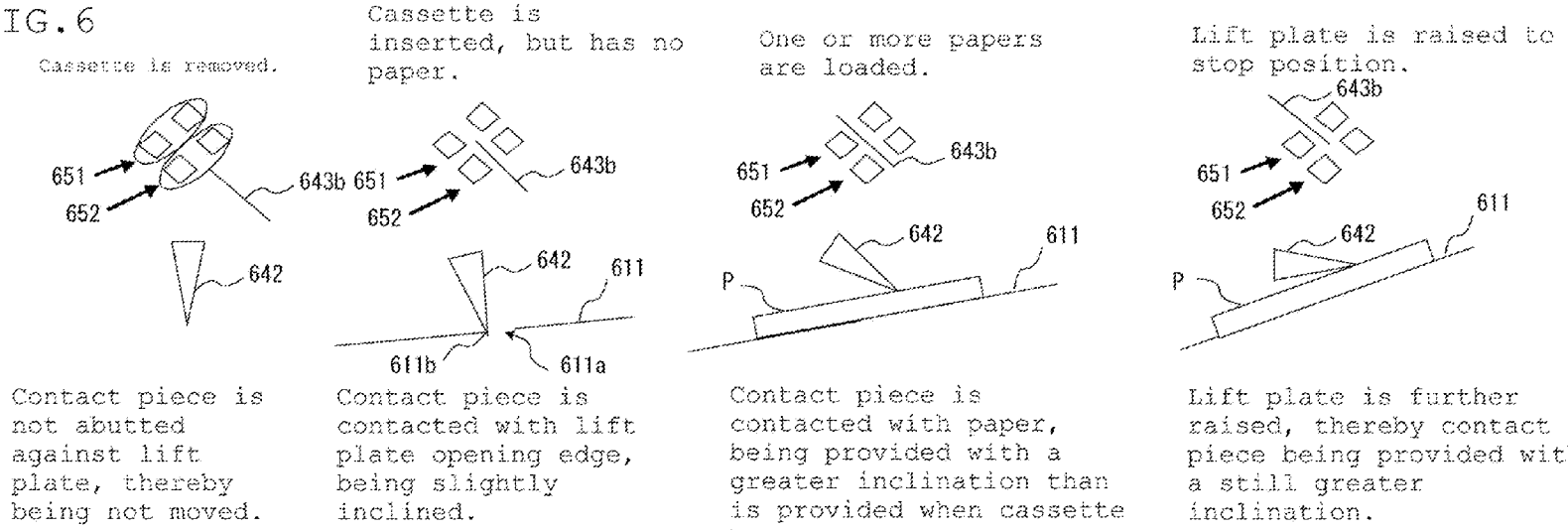
FIG. 6 is an image figure showing the motion of the actuator shown in FIG. 1.

Specifically, the lift plate 611 extends from the paper feed upstream side to the paper feed downstream side in FIG. 2, and from the middle (a place close to the paper feed upstream side), the opening edge part 611*b* extends from the back wall side to the front side in FIG. 2. Further, the paper feed cassette 61 has a space that allows the lower end part 642*a* of the contact piece 642 to be positioned below the lift plate 611 from the opening 611*a*. If no recording paper P is loaded on the lift plate 611, the contact piece 642 is contacted with the opening edge part 611*b* of the opening 611*a* formed in the lift plate 611. In this case, the lower end part 642*a* of the contact piece 642 is positioned below the lift plate 611, the contact piece 642 having the second inclination. When the recording paper P is loaded, the contact piece 642 is placed on the uppermost face of the recording paper P on the lift plate 611. If the lift plate 611 is raised with no recording paper P being loaded, the contact piece 642 is contacted with the opening edge part 611*b* of the opening 611*a* formed in the lift plate 611. In this case, the lower end part 642*a* of the contact piece 642 is positioned below the lift plate 611. A typical image forming apparatus has had a configuration in which, when the lift plate is raised with no recording paper being loaded in the paper feed cassette, a member of the sensor (the contact piece of the actuator) is dropped into an opening portion of the lift plate without being contacted with the lift plate. In the present disclosure, the mounting location of the sensor (the actuator 64) or the location of a hole (the opening 611*a*) is designed such that, when the lift plate 611 is raised with no recording paper P being loaded, the lift plate 611 is abutted against a member of the sensor (the contact piece 642). Further, the mounting location of the sensor (the actuator 64) is designed such that, in the state in which the recording paper P is fully loaded, the inclination of the member of the sensor (the contact piece 642) when the lift plate 611 is not raised is different from that when the lift plate 611 has been raised. In the present disclosure, in place of the remaining quantity detection sensor that has been provided in such location, two sensors (the first sensor 651 and the second sensor 652) are provided, whereby the inclination can be detected in four steps. This is schematically explained in FIG. 6. With the paper feed cassette 61 having been removed, the contact piece 642 is not abutted against the lift plate 611, thereby it being not moved. With the paper feed cassette 61 being inserted, but no recording paper P being loaded, the contact piece 642 is contacted with the opening edge part 611*b* of the opening 611*a* in the lift plate 611, thereby being slightly inclined. With one or more recording papers P being loaded, the contact piece 642 is contacted with the recording paper P, thereby being provided with a greater inclination than is provided when the paper feed cassette 61 that has been inserted has no recording paper P. In the state in which the lift plate 611 has been raised to the stop position, the lift plate 611 has been further raised, thereby the contact piece 642 having been provided with a still greater inclination.

Figure 4C:
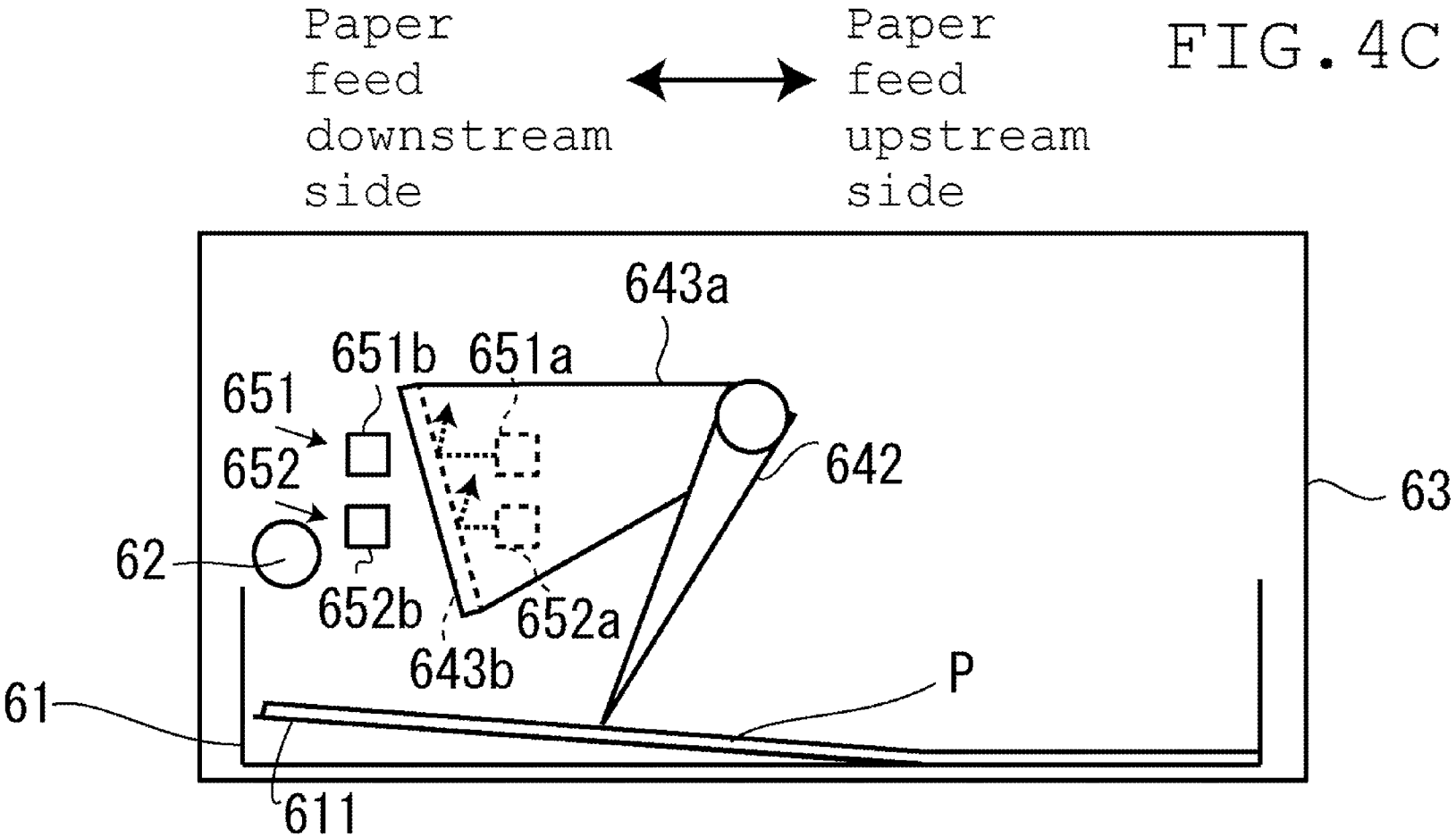
FIG. 4C is an image figure showing the motion of the actuator shown in FIG. 1.
Figure 4D:
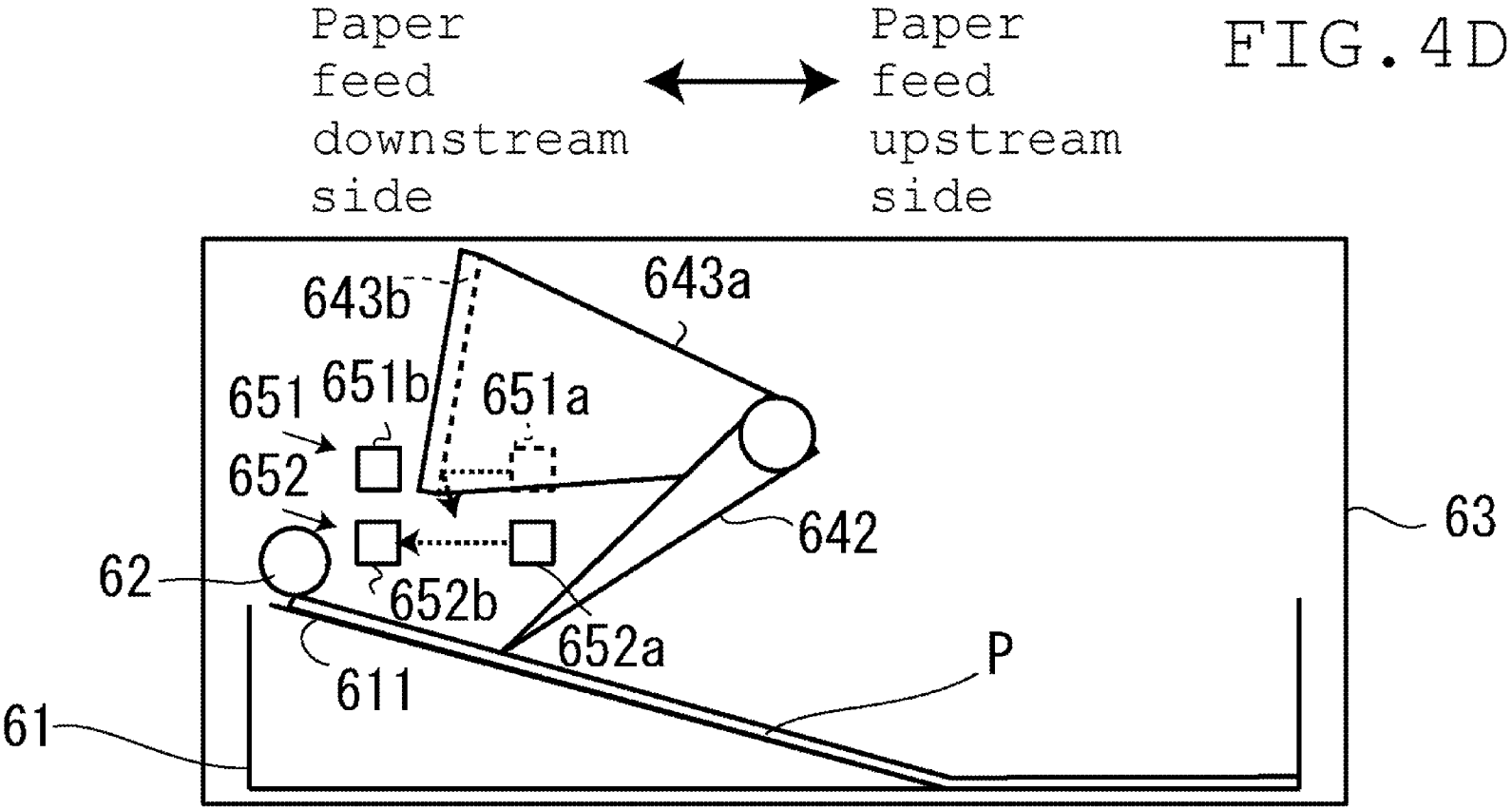
FIG. 4D is an image figure showing the motion of the actuator shown in FIG. 1.

As shown in FIG. 4C, when the paper feed cassette 61 is inserted into the cassette accommodating space 63 with one to a maximum allowable number of sheets of the recording paper P being loaded on the lift plate 611, the contact piece 642 is contacted with the uppermost layer of the recording papers P on the lift plate 611, being provided with a third inclination. This is because the opening 611*a* that is formed in the lift plate 611 is covered with the recording paper P. At this time, the lift motor is not yet driven. Further, the lift plate 611 is positioned in the lowest position in the range in which the lift plate 611 is raised by the lift motor being driven. When the contact piece 642 has the third inclination, the light shielding piece 643*b* is turned to a third position where the first sensor 651 and the second sensor 652 are turned ON. As shown in FIG. 4D, when the lift motor is driven to raise the lift plate 611 to the rising stop position, the contact piece is provided with a fourth inclination. With this, the light shielding piece 643*b* is turned to a fourth position where the first sensor 651 is turned ON and the second sensor 652 is turned OFF. When only the first sensor 651 is turned ON, the recording paper P is in the state in which it has been abutted against the feed roller 62 with the lift plate 611 having been raised. In other words, when the lift plate 611 has reached the rising stop position for feeding the recording paper P, the first sensor 651 is turned ON, and the second sensor 652 is turned OFF by the light shielding piece 643*b*.

In the case where the first sensor 651 and the second sensor 652 are OFF, a control part (not shown) reports, through the touch panel device 10, that the paper feed cassette 61 is not loaded. In the case where the first sensor 651 is OFF and the second sensor 652 is ON, the control part reports, through the touch panel device 10, that the paper feed cassette 61 has no recording paper P. In the case where the first sensor 651 and the second sensor 652 are ON, the control part reports, through the touch panel device 10, that the paper feed cassette 61 has the recording paper P. In the case where the first sensor 651 is ON and the second sensor 652 is OFF, the control part determines that the lift plate 611 has been raised to the rising stop position, and stops the lift motor driving. Any combinations of sensor output values other than that of the first sensor 651 and the second sensor 652 being OFF, which indicates that the paper feed cassette 61 is not loaded, indicate that the paper feed cassette 61 is loaded.

Further, in the present embodiment, the inclination of the contact piece 642 of the actuator 64 is different for each of the four combinations of sensor output values. In other words, the inclination is different for each of the case where the paper feed cassette 61 is not yet loaded; the case where the paper feed cassette 61 is loaded, having no recording paper P; the case where the paper feed cassette 61 is loaded, having the recording paper P; and the case where the lift motor has been rotation-driven to bring the lift plate 611 to the rising stop position. In each of these cases, the position of the light shielding piece 643*b*, which is turned in accordance with the inclination of the contact piece 642, is detected by two sensors (the first sensor 651 and the second sensor 652). Thus, in the present embodiment, whether or not the paper feed cassette 61 is loaded; whether or not the paper feed cassette 61 has the recording paper P; and whether or not the lift plate 611 has reached the rising stop position can be detected by using only two sensors of the same type. Accordingly, mounting of the components and the mechanism can be performed more simply and easily.

With a typical paper feeding apparatus, a detection part for detecting the recording paper; a detection part for detecting attaching/detaching of the paper feed cassette; and a detection part for detecting reaching of the lift plate at the rising stop position have been provided for the image forming apparatus. In this case, the configuration and the mounting position vary depending upon the respective detection parts, thereby the apparatus having become complicated.

According to the present disclosure, a technique can be provided which is capable of commonalizing the mechanisms for detecting the presence/absence of recording paper, attaching/detaching of the paper feed cassette, and reaching of the lift plate at the rising stop position.

The contact piece 642 may be mounted to the shaft part 641 such that, in the case where no recording paper P is placed on the lift plate 611, the contact piece 642 is contacted with the opening edge part 611*d* of the opening 611*c* formed in the lift plate 611, being inclined to the second inclination. Further, the present embodiment has been explained using the case where the paper feeding direction and the insertion direction of the paper feed cassette 61 are orthogonal to each other, as an example. However, the paper feeding direction and the insertion direction of the paper feed cassette 61 may be provided to be the same.

The present disclosure is not limited to the above-described embodiment, and of course can be altered in various ways within the scope of the gist of the present disclosure.

What is claimed is:

1. A paper feeding apparatus, including an attachable and detachable cassette having a lift plate, a paper being placed thereon, and a raising part to raise the lift plate, comprising:

a contact piece, being inclined by said lift plate;

a light shielding member, being turned in accordance with the inclination of the contact piece; and an optical sensor part, detecting a position of the light shielding member;

wherein:

an opening is formed in said lift plate;

said optical sensor part includes: a first sensor and a second sensor that are switched ON or OFF by said light shielding member;

said light shielding member reaches a first position, upon said cassette having been removed, thereby said contact piece having a first inclination;

when said light shielding member is positioned in the first position, said first sensor and said second sensor are turned OFF;

said light shielding member reaches a second position, upon said contact piece having been contacted with an opening edge part formed in said lift plate, thereby having a second inclination;

when said light shielding member is positioned in the second position, said first sensor is turned OFF and said second sensor is turned ON;

said light shielding member reaches a third position, upon said contact piece having been contacted with the uppermost layer of the paper placed on said lift plate positioned in the lowest position, thereby having a third inclination;

when said light shielding member is positioned in the third position, said first sensor and said second sensor are turned ON;

said light shielding member reaches a fourth position, upon said raising part having been driven to raise said lift plate to a rising stop position to feed said paper, thereby said contact piece having a fourth inclination; and when said light shielding member is positioned in the fourth position, said first sensor is turned ON, and said second sensor is turned OFF.

2. The paper feeding apparatus according to claim 1, including a control part that, when said first sensor and said second sensor are OFF, reports that said cassette is removed; when said first sensor is OFF, and said second sensor is ON, reports that said cassette has a paper; and when said first sensor is ON and said second sensor is OFF, stops said raising part driving.

3. An image forming apparatus comprising a paper feeding apparatus according to claim 1.

4. A paper feeding method, being implemented by a paper feeding apparatus including an attachable and detachable cassette having a lift plate, a paper being placed thereon, and a raising part to raise the lift plate, said paper feeding apparatus comprising:

a contact piece, being inclined by said lift plate; and a light shielding member, being turned in accordance with the inclination of the contact piece; and a light sensor part that detects a position of the light shielding member;

an opening being formed in said lift plate, wherein:

said optical sensor part has a first sensor and a second sensor that are turned ON and OFF by said light shielding member, and said light shielding member reaches a first position, upon said cassette having been removed, thereby said contact piece having a first inclination, wherein when said light shielding member is positioned in the first position, said first sensor and said second sensor are turned OFF; said light shielding member reaches a second position, upon said contact piece having been contacted with an opening edge part formed in said lift plate, thereby having a second inclination, wherein when said light shielding member is positioned in the second position, said first sensor is turned OFF and said second sensor is turned ON; said light shielding member reaches a third position, upon said contact piece having been contacted with the uppermost layer of the paper placed on said lift plate positioned in the lowest position, thereby having a third inclination, wherein when said light shielding member is positioned in the third position, said first sensor and said second sensor are turned ON; and said light shielding member reaches a fourth position, upon said raising part having been driven to raise said lift plate to a rising stop position to feed said paper, thereby said contact piece having a fourth inclination, wherein when said light shielding member is positioned in the fourth position, said first sensor is turned ON, and said second sensor is turned OFF.

* * * * *